US005234007A

United States Patent [19]

Holmes et al.

[11] Patent Number: 5,234,007

[45] Date of Patent: Aug. 10, 1993

[54] METHOD OF AND APPARATUS FOR RECLAIMING TOBACCO FROM CIGARETTE PACKAGES

[75] Inventors: Gregory A. Holmes; Clifford R. Marritt, both of Winston-Salem; John L. Nelson, Lewisville, all of N.C.

[73] Assignee: R. J. Reynolds Tobacco Company, Winston-Salem, N.C.

[21] Appl. No.: 753,777

[22] Filed: Sep. 3, 1991

Related U.S. Application Data

[63] Continuation-in-part of Ser. No. 493,082, Mar. 13, 1990, Pat. No. 5,117,843.

[51] Int. Cl.[5] ..... A24C 5/36

[52] U.S. Cl. ..... 131/96

[58] Field of Search ..... 131/96; 53/492, 381.1, 53/381.2, 382.2; 83/931, 19, 61; 414/411, 412

[56] References Cited

U.S. PATENT DOCUMENTS

| | | | |
|---|---|---|---|
| 3,026,880 | 3/1962 | Perrin . | |
| 3,103,222 | 9/1963 | Di Ianni . | |
| 3,224,451 | 12/1965 | Dearsley . | |
| 3,386,320 | 6/1968 | Pinkham et al. . | |
| 3,577,999 | 5/1971 | Pinkham . | |
| 3,583,447 | 6/1971 | Peterson | 53/381.1 |
| 3,690,484 | 9/1972 | Harlan . | |
| 3,757,799 | 9/1973 | Di Ianni et al. . | |
| 4,002,255 | 1/1977 | Fincham et al. . | |
| 4,036,380 | 7/1977 | Berry et al. . | |
| 4,083,499 | 4/1978 | Thatcher . | |
| 4,117,852 | 10/1978 | Newman et al. . | |
| 4,191,199 | 3/1980 | Sullivan . | |
| 4,221,035 | 9/1980 | Thatcher . | |
| 4,261,790 | 4/1981 | Brinker et al. . | |
| 4,278,100 | 7/1981 | Thatcher . | |
| 4,485,827 | 12/1984 | Komossa et al. . | |
| 4,622,875 | 11/1986 | Emery et al. . | |
| 4,843,801 | 7/1989 | Roncero . | |
| 4,867,179 | 9/1989 | Leonard . | |
| 5,001,951 | 3/1991 | Eisenlohr et al. | 131/96 X |
| 5,086,790 | 2/1992 | Greene, Jr. | 131/96 |

FOREIGN PATENT DOCUMENTS

| | | |
|---|---|---|
| 0118289 | 4/1984 | European Pat. Off. . |
| 2840999 | 4/1980 | Fed. Rep. of Germany . |
| 9012972 | 11/1990 | Fed. Rep. of Germany . |
| 656165 | 4/1929 | France . |
| 2158410 | 6/1985 | United Kingdom . |

*Primary Examiner*—V. Millin
*Assistant Examiner*—J. Doyle
*Attorney, Agent, or Firm*—Grover M. Myers

[57] ABSTRACT

A method and an apparatus for reclaiming tobacco from cigarettes is disclosed. The apparatus and method include a cigarette pack opener and a method of opening cigarette packs wherein the packs are conveyed by an endless conveyor along a path of travel having an arcuate portion and a linear portion. The packs are inputted to the conveyor at the arcuate portion where a pair of circular cutting knives are arranged to cut off the end panels of the pack. The packs are then conveyed to the linear portion of the path where pusher/squeeze bars are urged against the side panels of the pack to deform the pack and cause the cigarettes to fall from the pack by gravity into a collector. The empty pack is conveyed to another arcuate portion of the path where it is discarded.

31 Claims, 6 Drawing Sheets

FIG. 4
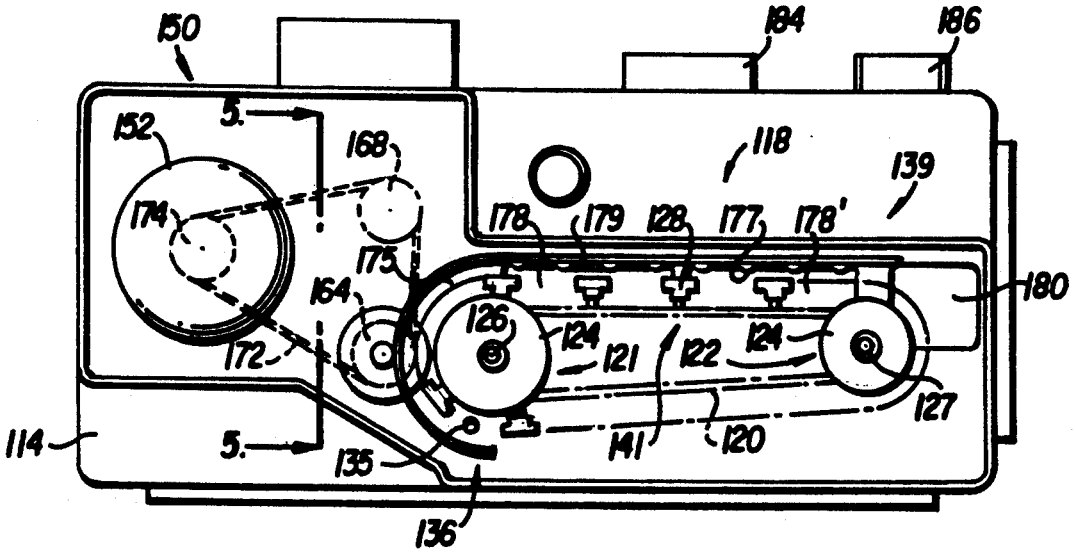
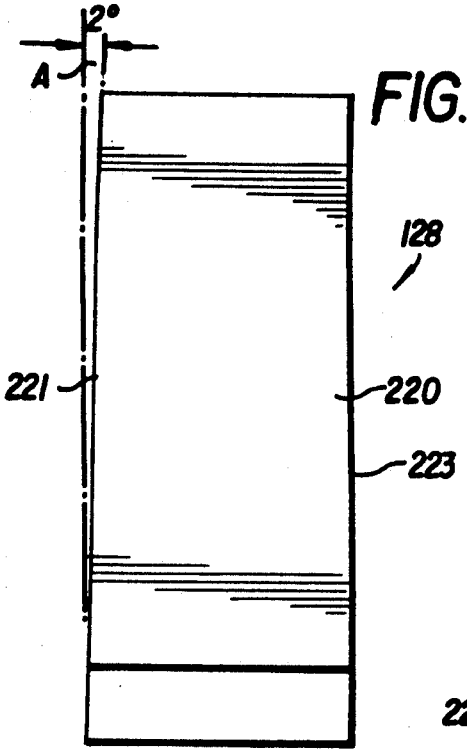
FIG. 8
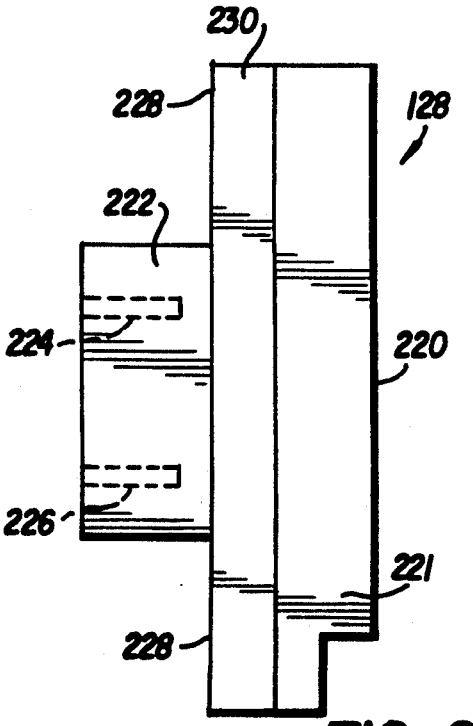
FIG. 9
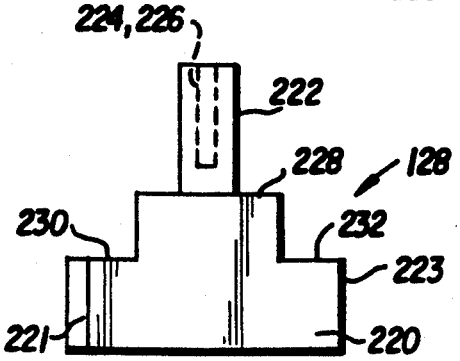
FIG. 10

METHOD OF AND APPARATUS FOR RECLAIMING TOBACCO FROM CIGARETTE PACKAGES

This application is a continuation-in-part of U.S. application Ser. No. 07/493,082, filed 3/13/90, now U.S. Pat. No. 5,117,843.

FIELD OF THE INVENTION

The present invention relates to the reclamation of smokable material used in making smoking articles such as cigarettes, and in particular, to a method of and an apparatus for making cigarettes which includes the steps of and means for opening cigarette packs, removing cigarettes from the packs to facilitate individual cigarette recovery, and removing the smokable material from the recovered cigarettes, thereby facilitating tobacco reclamation.

DESCRIPTION OF THE PRIOR ART

Cigarettes which may be recovered and reclaimed according to the present invention can vary in composition and construction. Typically, cigarettes comprise a rod of smokable material, such as a blend of shredded tobacco laminae, volume expanded shredded tobacco laminae, cut and processed tobacco stems, shredded reconstituted tobacco, and the like. The smokable material or cut filler is circumscribed by an outer wrapping material such as cigarette paper, e.g., a calcium carbonate and flax paper, thereby forming a tobacco rod. Tobacco rods typically have lengths of about 40 mm to about 85 mm, preferably about 55 mm to 70 mm, and circumferences of about 17 to about 27 mm, preferably about 22 mm to about 25 mm. For filter cigarettes, a filter element normally manufactured from plasticized cellulose acetate tow and circumscribed by a paper plug wrap is attached to one end of the tobacco rod. Filter elements can have flavors incorporated therein, contain charcoal, or the like. Filter elements typically have lengths of about 10 mm to about 40 mm, preferably about 15 to about 35 mm; and have circumferences comparable to that of the tobacco rod to which they are attached. A tipping paper typically circumscribes the filter element and an adjacent region of the tobacco rod so as to fixedly secure the filter element to the tobacco rod. Typical filter cigarettes are about 79 mm, about 84 mm and about 99 mm in length.

Cigarettes conventionally have been sold in packages called "packs," and each pack normally contains 20 cigarettes. The cigarettes are usually arranged in a matrix of three rows having 7 cigarettes, 6 cigarettes and 7 cigarettes, respectively. Typical cigarette packs have a generally rectangular parallelepiped form, with front and back panels. According to the terminology used herein, the two end panels are the top and bottom of the pack. One type of popular cigarette pack employs a container having the form of a so-called "hard pack," "crush proof box" or "hinged lid package." Another type of popular cigarette pack employs a container having the form of the so-called "soft pack." Both types of cigarette pack typically are overwrapped by a clear polymeric film (e.g., a polyethylene or polypropylene overwrap film) to maintain freshness of the cigarettes within the container. A strip of polymeric material known as a "tear tape" is provided adjacent the top of the pack for easy opening of the polymeric overwrap film. Cigarette packs are packaged in cartons, typically ten packs per carton.

In order to maintain proper quality control during the manufacture and packaging process, defective packs or cartons are eliminated from the ultimate product stream, and separated for further reprocessing and reclamation of the tobacco therein. In addition, individual packs and cartons, which are otherwise acceptable, but which were part of field tests or promotional efforts which have expired or which have been completed, may also be returned for reclamation. Heretofore, in order to effect the removal of the tobacco from the packs and cartons, a significant amount of manual labor was involved. This included the opening of the individual cartons and then the opening of the individual packs, the removal of the cigarettes and the ultimate removal of the tobacco from the cigarettes.

In another prior art device, a hammermill is used to break up whole cartons and/or packs into a particulate mixture of tobacco, packaging material, filter elements and cigarette paper and thereafter the tobacco particles are separated from the mixture. For example, U.S. Pat. No. 3,577,999 to Pinkham is directed to a rotating vane device and sieve for separating tobacco from the filter and paper. The tobacco that is removed from the cigarettes is collected, reconstituted and reconditioned and then introduced into the tobacco blend as "shorts".

A more recent development is disclosed in U.S. Pat. No. 4,036,380 to Berry et al. in which a pair of cutter blades are used to open the sides of cigarette cartons and the ends of the packs contained therein. Air jets are then used to blow the cigarettes from the opened packs into a pneumatic separator where the cigarettes are separated from any wrapping materials by gravity.

Suitable methods and systems for in-line tobacco reclamation with a maker/tipper/packer have been developed previously. Among these are the method and system disclosed in U.S. Pat. No. 4,867,179 to Leonard which is assigned to the assignee of this invention. The system and method disclosed in Leonard is directed to tobacco reclamation from one or more cigarette making machines, in which cigarettes are reclaimed from packs and the tobacco is separated from reclaimed cigarettes, rejected cigarettes and long ends. The separated tobacco is then screened and metered. The larger tobacco particles are redirected back to the tobacco supply for the cigarette maker and the smaller tobacco particles are metered and formed into reconstituted tobacco which is then cut and fed back to the tobacco supply.

In addition, various other efforts have been undertaken to automate the tobacco reclamation process. Examples of efforts directed to removing cigarettes from cigarette packs include the following patent documents: U.S. Pat. No. 4,843,801 to Roncero; U.S. Pat. No. 4,083,499 to Thatcher; U.S. Pat. No. 4,221,035 to Thatcher; European Patent Publication No. 0118289; U.K. Patent Application No. GB 2158410A; U.S. Pat. No. 3,386,320 to Pinkham et al.; U.S. Pat. No. 4,622,875 to Emery et al.; U.S. Pat. No. 4,002,255 to Fincham et al.; and PCT Application W090/11937.

In addition to patents directed to the removal of cigarettes and tobacco from intact packages, efforts have also been directed toward removal of tobacco from individual cigarettes as well. Examples of such efforts include: U.S. Pat. No. 4,261,790 to Brinker et al.; U.S. Pat. No. 4,278,100 to Thatcher; U.S. Pat. No. 4,117,852 to Newman et al.; U.S. Pat. No. 3,103,22 to DiIanni; U.S. Pat. No. 4,191,199; U.S. Pat. NO. 3,757,799 to DiIanni et al.; U.S. Pat. No. 3,026,880 to Perrin; U.S Pat. No. 3,224,451 to Dearsley; U.S. Pat. No. 4,485,827 to Komassa et al.

Many of the prior art methods and apparatus for tobacco reclamation involve intrusive, destructive means and methods for performing the separation of cigarettes from packaging materials. Such means and methods often resulted in degradation of the tobacco itself, either by reducing the size of the tobacco fiber strands, or in drying out the tobacco. Additionally, the option of recovering intact and otherwise acceptable individual cigarettes is limited in those processes which separate cigarettes from packs by means of devices which interact simultaneously with the cigarettes and packaging materials as, for example, by beating the packs with a hammermill or by slicing the packs and cigarettes. Furthermore, because in many of the abovementioned prior art methods and devices, the packaging, cigarette paper and filter material are each being subjected to the same separation forces as the tobacco, there is an increased likelihood that the tobacco will suffer some contamination of the non-tobacco parts i.e., the paper, foil, etc. of the packaging or the tow, charcoal, flavorant, etc. of the filter.

As a result of the deficiencies in prior tobacco reclamation efforts, it would be desirable to provide a method and apparatus for the in-line reclamation of tobacco used in making cigarettes which includes the steps of and means for opening cigarette packs and removing cigarettes from the packs to facilitate individual cigarette recovery and removing the tobacco from the recovered cigarettes, thereby facilitating tobacco reclamation. Such desirable method and apparatus should accomplish this result while minimizing the degradation of the recovered cigarettes and reclaimed tobacco.

SUMMARY OF THE INVENTION

The present invention is directed to a method and apparatus useful for the recovery of tobacco from cigarette packages. The invention offers a minimally intrusive method of and apparatus for removing individual cigarettes from cigarette packs, allowing for minimal contamination of the resulting reclaimed tobacco. The apparatus according to the present invention can be used in-line with a cigarette maker/tipper/packer to reclaim tobacco filler from individual cigarettes or as a stand-alone apparatus for recovering individual cigarettes for subsequent reclamation of tobacco filler. The likelihood of damage to or degradation of the reclaimed tobacco is reduced using the present invention. When used in an in-line maker, the method and apparatus do not result in diminished tobacco moisture content, because reclaimed tobacco is returned with substantially the same moisture content as it had when first made into cigarettes. Typical moisture content of tobacco filler material is 10 to 15%, preferably 12 to 13% during cigarette manufacture. Substantial recovery and return of tobacco is possible, with 95% or more of the tobacco being removed from cigarettes being returned to the cigarette maker for the manufacture of new cigarettes.

The present invention is directed to a method and apparatus for reclaiming tobacco in which individual packs of cigarettes are conveyed to an opener stage which removes both end panels of a cigarette pack, i.e., the top and bottom panels, and then to an extraction stage in which (a) the cross-sectional area of the pack in a plane substantially parallel to the pack ends is increased, thereby loosening the packed cigarette matrix, and (b) a non-intrusive removal force is applied to remove the cigarettes from the pack and to separate the packaging material from the removed cigarettes, without any apparatus or device actually entering the pack. The removed cigarettes are transported to further processing in which the tobacco is separated from the filter and paper of the cigarettes and the tobacco is returned to the input hopper for the maker. Alternatively, the further processing could involve repacking of intact and otherwise acceptable individual cigarettes into packs. The packaging material itself is preferably disposed of, but may be recycled where appropriate.

The pack opener apparatus and method of the invention includes the steps of and means for cutting off the end panels of the cigarette packs, deforming the cigarette packs and extracting the cigarettes from the pack solely by the force of gravity. The packs enter the pack opener in a vertical orientation, i.e., with the top and bottom end panels disposed in spaced horizontal planes, and are conveyed or indexed by an endless conveyor past a pair of vertically spaced, horizontally disposed cutter knives or blades which cut off the top and bottom end panels of the cigarette packs. The endless conveyor then deforms the packs from their rectangular cross sectional shape to loosen or dislodge the 7-6-7 packed cigarette matrix and conveys or indexes the deformed packs over a drop out window or opening. The loosened cigarettes fall by gravity through the drop out opening and are guided by a chute to a collection bin or, are pneumatically conveyed to a reclamation system of a cigarette maker. The empty packs or wrappers are conveyed or indexed to a position to permit the packs to fall by gravity from the conveyor and into a waste collection means. A vacuum system is provided at the cutting station for vacuuming away the top and bottom end panels and any wrapper or filter debris that results from the cutting operation.

With the foregoing and other advantages and features of the invention that will become hereinafter apparent, the nature of the invention may be more clearly understood by reference to the following detailed description of the invention, the appended claims and to the several views illustrated in the drawings.

BRIEF DESCRIPTION OF THE DRAWINGS

FIG. 4 is a top view of the pack opener apparatus of FIG. 3;

FIGS. 8–10 are front elevation, side elevation and top views, respectively, of a pusher bar of the pack opener apparatus of the invention.

DETAILED DESCRIPTION OF THE INVENTION

Figure 1:
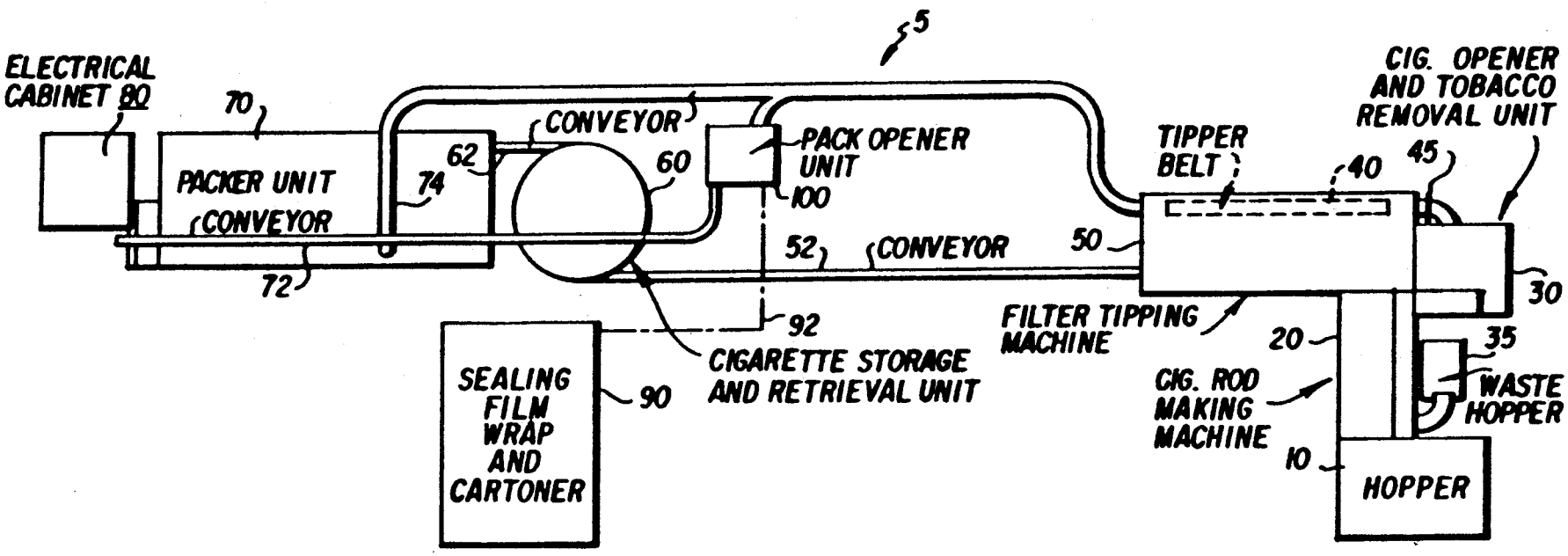
FIG. 1 is a schematic drawing of a cigarette maker and a packer incorporating a pack opener according to the present invention.
Figure 2:
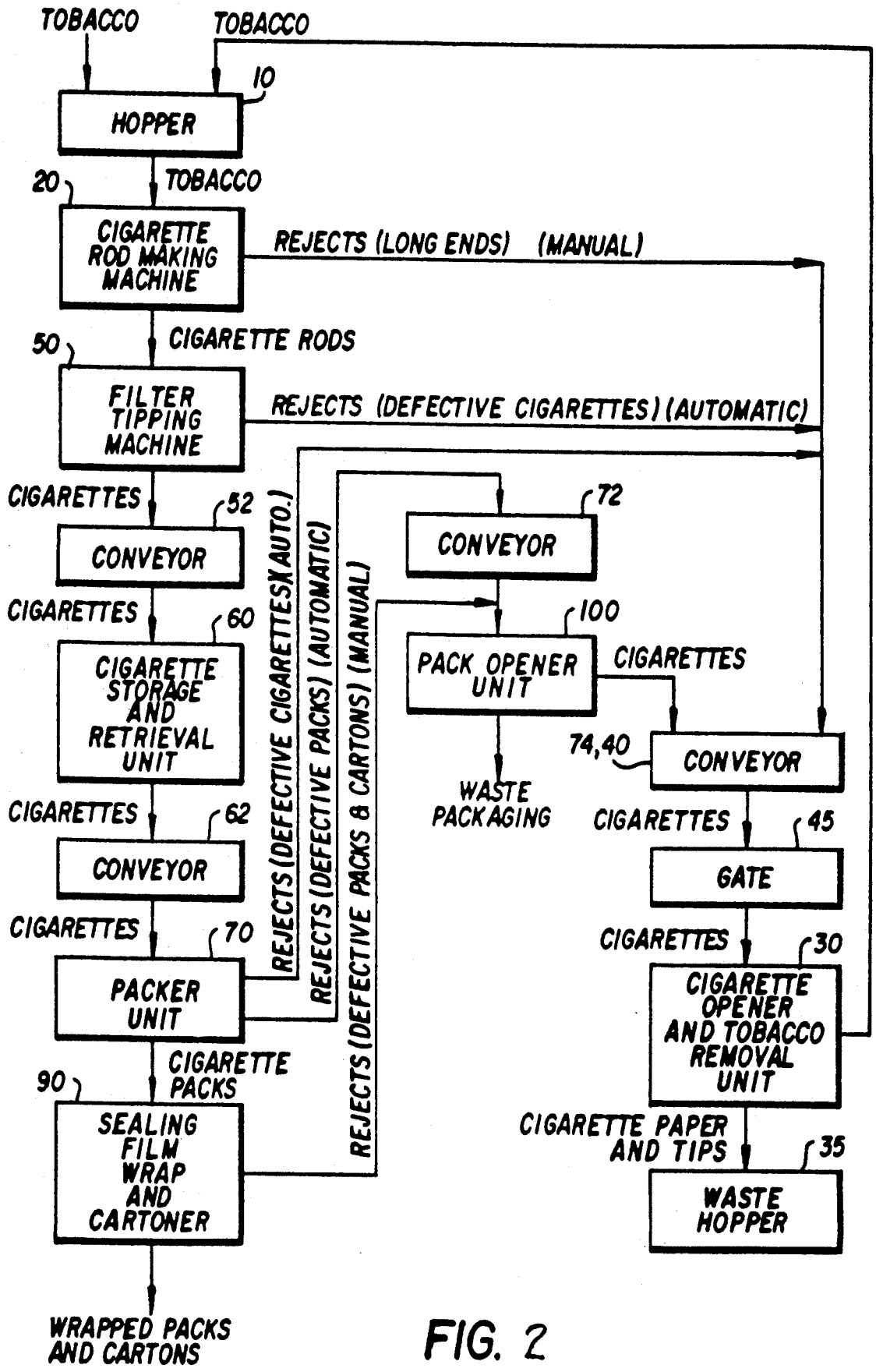
FIG. 2 is a flow chart showing the flow of tobacco, cigarettes, cigarette packs and rejects in the cigarette maker, packer and pack opener systems of FIG. 1.

Referring first to FIGS. 1 and 2, tobacco is supplied to a cigarette rod making machine 20 by a hopper 10, which may be a PROTOS VE-80 model, manufactured by Hauni-Werke & Korber Co. KG, West Germany. The cigarette rod making machine 20 forms rods of smokable material, wrapped in a tube of cigarette paper. Properly formed rods are transported to a filter tipping machine 50, described below. "Long ends", which are produced during the startup of the rod making machine 20, and defective cigarette rods are manually removed by the operator and transported to a cigarette opener and tobacco removal unit 30, described below. Automatic transport means may also be provided.

The cigarette rod making machine 20 useful in carrying out this invention is of the type commercially available from Molins PLC, Great Britain or Hauni-Werke & Korber Co. KG and the use thereof is well-known to the skilled artisan. For example, a preferred cigarette rod making machine of the type known as a PROTOS 80 (commercially available from Hauni-Werke & Korber Co. KG) can be employed. A description of a PROTOS cigarette making machine is provided in U.S. Pat. No. 4,474,190 to Brand which is incorporated herein by reference. Other cigarette rod making machines, such as the PROTOS 100, manufactured by Hauni-Werke & Korber Co., KG and the Molins MK 10N, manufactured by Molins PLC, can also be employed.

The cigarette rod making machine 20 is directly coupled with the filter tipping machine 50, such as a MAX 80 commercially available from Hauni-Werke & Korber Co. KG, which affixes filters to the ends of the cigarette rods. If regular, non-filter cigarettes are to be made, no filter tipping machine is employed. Finished cigarettes are inspected and those meeting the appropriate quality standards are transported by conveyor 52 to cigarette storage and retrieval unit 60 which may be a model GDS90, manufactured by G. D. Societa per Azioni, Bologna, Italy. An alternative cigarette storage and retrieval unit 60 could be a System 88 available as OSCAR from Molins PLC. Defective cigarettes from the tipping machine 50 are transported automatically to cigarette opener and tobacco removal unit 30 by tipper belt conveyor 40.

From storage and retrieval unit 60, the cigarettes are transported via conveyor 62 to packer unit 70, which may be a model GDX-1 manufactured by G. D. Societa per Azioni. In lieu of a conveyor belt, cigarettes can be collected in cigarette trays (not shown), such as cigarette tray 82–86 mm available from Sasib as part no. P930203005F, and transported manually to the packer unit.

Individual cigarettes are packed typically 20 to a soft pack or crush-proof box with the cigarettes positioned in a 7-6-7 matrix. Other matrices may be used and the invention disclosed herein will accommodate such other matrices. After the cigarettes are packaged in individual packs, the cigarette packs are inspected and those found meeting the appropriate quality standards are transported to sealing film wrap and cartoner unit 90, which may be a model GD4350, manufactured by G. D. Societa per Azioni, where the packs are wrapped in a polymeric film, such as polyethylene or polypropylene, sealed and cartoned. Packs which are found defective in packer 70 are automatically transported by elevated conveyor 72 to pack opener unit 100. In addition, improperly cartoned or sealing film-wrapped packs can be transported manually (shown by dotted line 92, FIG. 1) to the hopper (not shown) for pack opener unit 100, the operation of which is explained in detail below.

Individual cigarettes which for some reason were rejected or not properly packaged in the packer 70 are automatically transported back along conveyor 74 for further processing. Conveyor 74 may be a pneumatic conveyor or a MAX 80 reject belt system manufactured by Hauni-Werke & Korber Co. Rejected packs are opened by pack opener 100, as described in greater detail hereinafter. The individual cigarettes extracted by pack opener 100 are also transported by conveyor 74 to tipper belt 40 and thence to cigarette opener and tobacco removal unit 30 for further processing. The flow of individual cigarettes on conveyor 74 is combined with the flow of individual cigarettes on conveyor 40 which were rejected in the filter tipping machine 50. The further processing of the combined flows of conveyors 74 and 40 includes the process of separating the tobacco from the filter and cigarette paper, as necessary. This process is accomplished in cigarette opener and tobacco removal unit 30, which may be a wet-belt type cigarette opening device, as, for example, a Niepmann-type HWR, manufactured by Niepmann GmbH, Gevelsburg, West Germany. Alternatively, the intact cigarettes could be inspected and those which are otherwise acceptable could be conveyed back to cigarette storage and retrieval unit 60, ultimately to be packed by packer unit 70.

The known Niepmann-type HWR separation unit 30 is a compact apparatus measuring approximately 1 meter by 1 meter by ¾ meter high. It is typically situated behind the cigarette rod making machine 20 and receives the rejects from the tipper 50 via tipper belt 40 which deposits them in a rotary vibrating feeder bowl on the Niepmann unit. The vibrating feeder bowl acts as a buffer and continuously outfeeds the cigarettes in-line at a constant output to the separation apparatus of the Niepmann unit. The Niepmann unit is characterized as a wet-belt cigarette opening device because cigarettes are first wetted on a small conveyor belt thereby creating a weakened strip in the paper along the bottom of each cigarette rod. The cigarettes are then passed through a grooved roller under pressure to break the paper along the weakened strip and then through rotary brushes that knock the tobacco from the cigarette rod leaving the filter intact with the cigarette paper attached to it. The loose tobacco, paper and filter are fed upwardly and across the top of the cigarette rod maker 20 over a screener with an approximately 8 millimeter mesh screen to remove the tobacco. The tobacco is deposited onto a trim-return feeding conveyor directly to hopper 10. The waste paper and filters are collected in a waste hopper 35, but, alternatively, could be collected in a central system. In order that the hopper 10 does not overflow, a gate 45 is provided at the entrance to the cigarette opener and tobacco removal device 30. This gate is lowered into place to stop the flow of cigarettes to be opened if the rod maker 20 is not operating, so that there is no accumulation of excess tobacco.

Power and controls are supplied to the entire system by electric cabinet 80.

As will be recognized by those skilled in the art, the individual elements of the system shown in FIGS. 1 and 2 are commercially available from a number of sources, with the exception, of course, of the pack opener 100. The addition of the pack opener 100 to such a system results in a unique combination of elements with a marked improvement in cigarette making efficiency and reduced wastage. This is because the addition of the pack opener 100 permits in-line reclamation of the tobacco and, as disclosed herein, properly configured, a system employing the pack opener 100 permits the option of reclamation of intact and otherwise acceptable cigarettes for recycling to the packer 70 without having the tobacco first removed from the individual cigarettes.

The method and system of the present invention has a number of important advantages. Among these are that the method and system are brand-specific, that is, the specific blend of tobacco used in making cigarettes is reclaimed and recycled directly back to the hopper containing that blend. The compactness of the components used results in low handling and hence low tobacco degradation and waste of the smokable material. Because the reclamation and recycling of tobacco is contemporaneous with the making of cigarettes and is relatively fast, moisture loss is low, resulting in no reconditioning of the tobacco being required. Thus, the reclaimed tobacco that is returned to the hopper has substantially the same predetermined moisture content as the tobacco in the hopper. Typical moisture content of tobacco filler material is 10% to 15%, preferably 12% to 13% during cigarette manufacture. Because of the relatively gentle nature of the pack opening and cigarette opening and tobacco removal components, the quantity of "shorts" is small. Finally, the method and system result in a high recovery rate of tobacco with at least 95% of the tobacco that is recovered from the cigarettes being returned to the hopper.

FIGS. 3–10 illustrate a preferred embodiment of a pack opener apparatus 100 which can be utilized in the cigarette making and packaging system shown in FIG. 1. The method of pack opening and cigarette extraction used in the present invention includes the steps of removing at least one, but preferably both, of the end panels of a cigarette pack, followed by the application of a non-intrusive removal force to extract the cigarettes substantially intact from the pack. In order to perform these steps, the pack must be held and conveyed past devices for removing one or both of the end panels, such as a rotating circular knife or knives. The cigarette matrix is then loosened by applying a force which deforms the pack and tends to increase the cross-sectional area of the pack at least at one open end thereof, with a removal force being simultaneously or subsequently applied, such as a jet of air, centrifugal force, or in the case of the present embodiment, the force of gravity. The removal force is non-intrusive in that no apparatus or device is actually inserted into or otherwise enters the pack to remove the cigarettes therefrom.

Pack deformation and cigarette removal can be performed by: (1) passing a pack opened at both ends through a converging chute or passage formed by the runs of a system of converging belts to deform the pack to increase the cigarette matrix cross-sectional area and then applying a jet of air to blow the cigarettes out of the pack; (2) rotating the opened pack in an arc through a converging chute or passage formed by a system of parallel rollers, thereby deforming the pack and applying centrifugal and gravity forces to eject the cigarettes from the pack; (3) rotating the opened pack in an arc through a converging chute or passage formed by a system of rollers and a rotating disk, thereby deforming the pack and applying centrifugal and gravity forces to eject the cigarettes from the pack; or (4) turning the pack so that at least one open end is oriented downwardly and deforming the pack by applying a vacuum to the front and back panels of the pack, thereby allowing the cigarettes to fall out of the pack under the force of gravity.

According to the present embodiment of the invention shown in FIGS. 3–10, pack deformation is performed by reducing the spacing between adjacent pusher bars on an endless conveyor to deform cigarette packs disposed between adjacent pusher bars. Cigarette removal is accomplished by conveying the deformed packs past an opening at the bottom of the pack to permit the cigarettes to fall by gravity from the pack.

Referring now more particularly to FIGS. 3–7, the preferred embodiment of the pack opener apparatus 100 will be described. The apparatus 100 comprises a frame 102 having upper and lower sections 104, 106 respectively. The frame 102 is supported on vertically adjustable pads or feet 108 in a conventional manner and includes a bottom plate 110, a central plate 112 and upper plates 114 and 115 on which the various components of the apparatus are mounted.

Cigarette packs P are delivered by gravity to the pack opener 100 by means of a chute 116 in a vertically oriented stack, that is, with the bottom end panel of one pack confronting the top end panel of the pack below the one pack. An endless conveyor 118 is supported between upper plates 114, 115 and comprises, in the preferred embodiment, a link chain 120 trained about a pair of rotatable shaft assemblies 121, 122. Each shaft assembly 121, 122 (FIG. 6A) comprises a sprocket 123 engageable with chain 120 and upper and lower pressure rollers 124, 125. Shaft assemblies 121, 122 are mounted on a respective shaft 126, 127. A plurality of elongated pusher/squeeze bars 128 are affixed to the link chain 120 by angle fittings 129 and screws 131 and bear against the outer peripheries of the upper and lower pressure rollers 124, 125 (FIG. 6A) as they travel about the rollers.

The conveyor 118 is preferably incrementally indexed by a drive train comprising an indexing drive motor 130 (FIG. 3) which indexes shaft assembly 122 in the direction shown by the arrow (FIG. 4) by means of a conventional wrap spring clutch mechanism 132 and toothed belt and pulley arrangement 134 connected between the clutch 132 and indexing motor 130.

Figure 3:
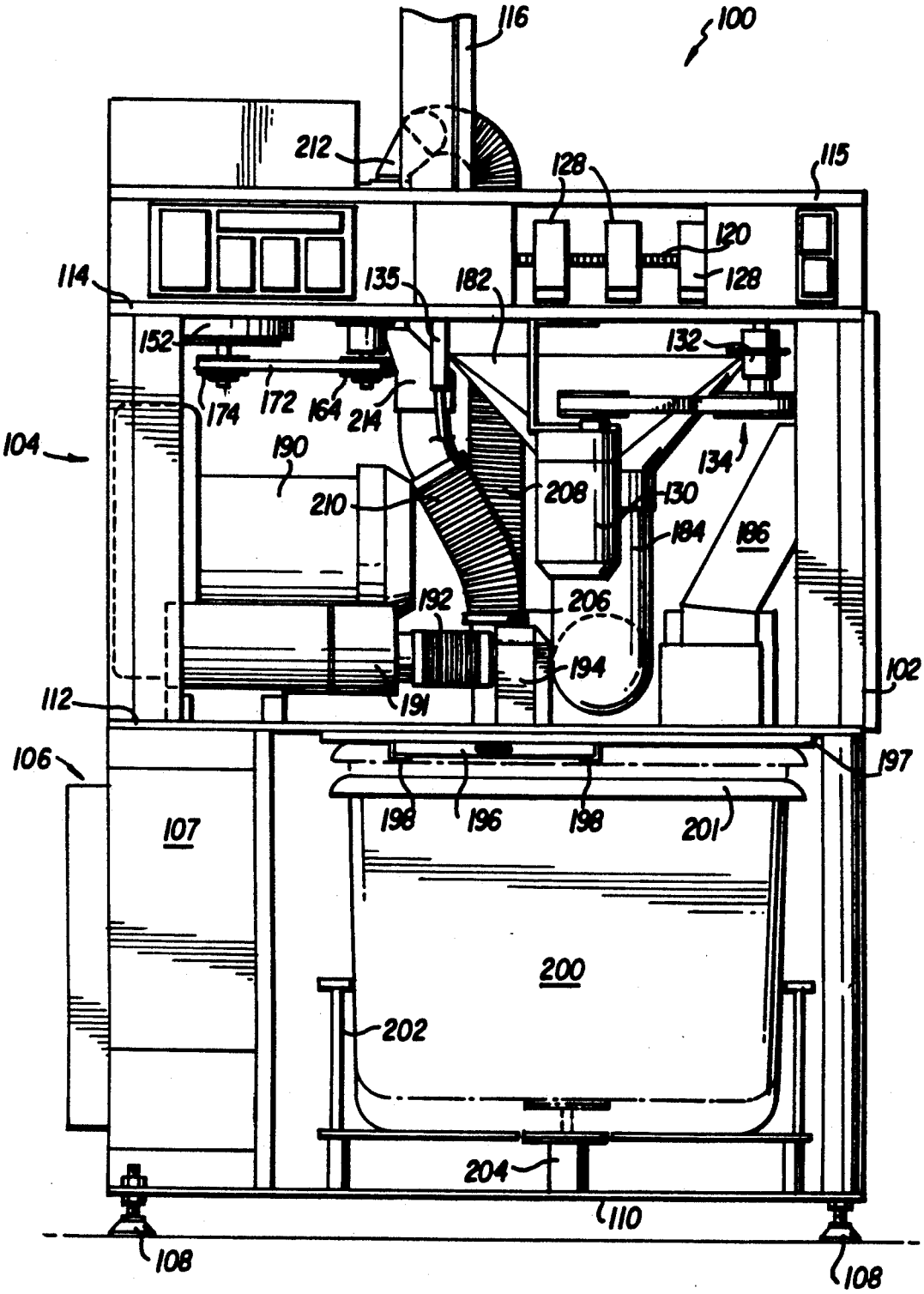
FIG. 3 is a front elevation view of a pack opener apparatus that may be used in the cigarette making system of FIG. 1 or as a stand-alone unit.
Figure 6:
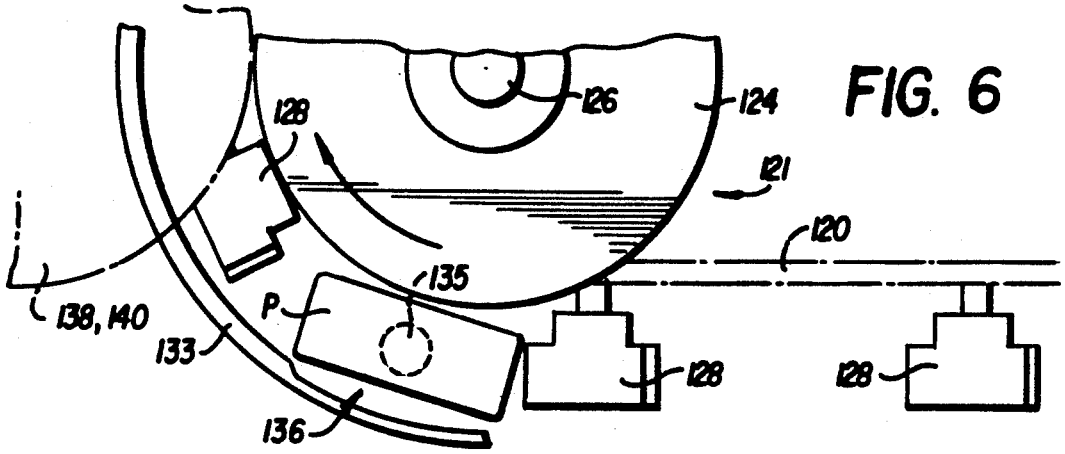
FIG. 6 is fragmentary top view of a portion of the pack opener showing the inlet position of a cigarette pack in the apparatus.

As best shown in FIGS. 3 and 6, cigarette packs P are fed one-at-a-time to conveyor 118 by gravity from chute 116 at an infeed position 136 adjacent shaft assembly 121. A proximity sensor 135 (FIGS. 3 and 6) is mounted to plate 114 for sensing the presence of a cigarette pack P at the infeed position 136. The pusher bars 128 adjacent pack P at infeed position 136 are spaced apart a distance sufficient to receive pack P therebetween. It will be understood by those skilled in the art that as the pusher bars 128 are indexed from their positions on the linear portions of the conveyor to their positions on the arcuate portions of the conveyor, the dimension or distance between the pusher bars 128 increases. Similarly, as the pusher bars are indexed from the arcuate conveyor portions to the linear conveyor portions, the distance between the pusher bars 128 decreases and causes the pusher bars 128 to deform any pack P located between adjacent pusher bars (FIG. 7) for a purpose to be hereinafter described. A vertical retaining wall 133 is spaced outwardly from the arcuate portion 137 and the linear portion 141 of the conveyor 118 to retain the packs P on the conveyor as they travel from the infeed position 136 to the discharge position 139 at the end of linear conveyor portion 141 (FIG. 4).

Figure 5:
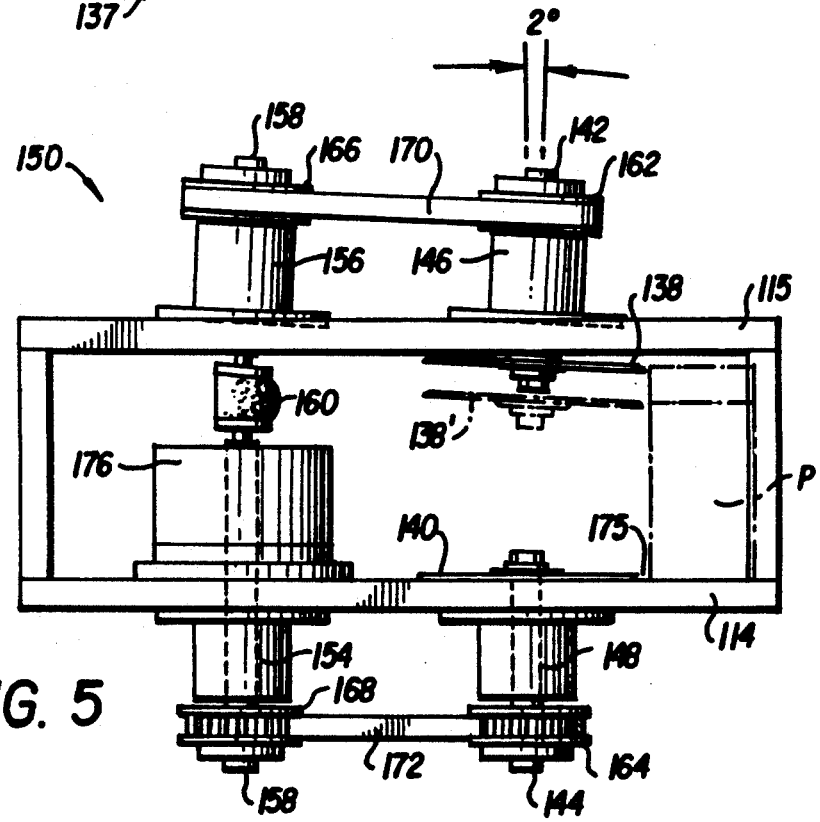
FIG. 5 is a partial side elevation view of the arrangement of the pack cutter knives taken along line 5—5 in FIG. 4.

Referring now to FIGS. 5 and 6, means are provided for opening both ends of the cigarette packs P by conveying the packs P past a pair of vertically spaced, upper and lower circular knives 138, 140 which are mounted adjacent the infeed position 136 and shaft assembly 121 so as to overlap the path of travel of the packs P on the conveyor 118. Circular knives 138, 140 may be 15° single bevel carbide knives. The knives 138 and 140 are mounted on shafts 142, 144 which are rotatably supported by antifriction bearings in upper and lower bearing housings 146, 148 rigidly fixed to respective plates 115, 114. Shaft 142 has a length sufficient to support knife 138 in a plurality of vertical positions depending on the height or length of the cigarette packs P being opened by the apparatus. For example, knife 138 is shown in position for cutting open packs P having a length of 100 millimeters. If shorter length packs are being opened, e.g., 85 millimeter packs, the knife is repositioned using spacers to the position shown in phantom as knife 138'.

To avoid binding of the packs P between the knives 138, 140, the upper bearing housing 146 is mounted on plate 115 so that the rotational axis of shaft 142 is inclined at a small angle of about 2°. The knives 138, 140 are driven in the same direction at a speed of about 1200–1700 RPM by a cutter drive arrangement 150 (FIG. 4). Drive arrangement 150 comprises a drive motor 152, a pair of bearing housings 154, 156 mounted respectively in plates 114, 115 for supporting a lay shaft assembly 158 for driving the upper knife 138. Shaft assembly 158 is provided with a flexible coupling 160 to accommodate the angular inclination from the vertical of shaft 142 and housing 156. Toothed pulleys 162, 164 are mounted on one end of a respective shaft 142, 144 and toothed pulleys 166, 168 are mounted on the opposite ends of shaft 158. A toothed belt 170 is trained about pulleys 162, 166 and a toothed belt 172 is trained about pulleys 164, 168 and a toothed pulley 174 mounted on the shaft of drive motor 152. A fail safe brake 176 is operatively connected to shaft 158 and functions to bring the rotating knives to a stop immediately when the power to the knife drive motor is interrupted whether due to safety lock-outs or a power failure.

The plate 114 is provided with elongated drop out windows or openings 178, 178' directly beneath the pusher bars along the linear portion 141 of the conveyor 118. A discharge opening 180 is provided in plate 114 at the downstream end of linear portion 141 adjacent shaft assembly 122. A collector funnel 182 is mounted to the underside of plate 114 beneath the drop out windows 178, 178' and is connected to a cigarette outlet pipe 184. A discharge chute 186 is mounted to plate 114 beneath opening 180.

The upper and lower knives 138, 140 may be vertically arranged to cut off the ends of the package only, i.e., without cutting off any portion of the cigarettes or cigarette filters. However, in the presently preferred case wherein tobacco from the cigarettes is to be reclaimed rather than individual cigarettes, it is preferable to adjust the knives to cut off about 2–4 millimeters from both ends of the cigarette packages to insure that all portions of the package ends have been removed. In that arrangement, approximately 1–3 millimeters are cut off from both ends of the cigarettes and cigarette filters. As shown in FIGS. 4 and 5, to support the cut off lower end of the cigarette packs downstream of the lower knife 140, a slide plate 175 is mounted to the upper surface of upper plate 114 and extends between the downstream edge of lower knife 140 to the upstream end of the drop out window 178. The top surface of slide plate 175 is substantially coplanar with the top surface of lower knife 140 so that as the pack lower ends are cut off, they slide without tilting onto the top surface of slide plate 175.

A vacuum system is mounted on the plates 110, 112 in the upper and lower portions 104, 106 of the apparatus and comprises a vacuum pump 190, the suction inlet 191 of which is connected via a flexible hose 192 to a fitting 194 mounted to central plate 112. Fitting 194 has an internal passage which communicates with an opening (not shown) in plate 112. A removable air filter 196 is supported on a pair of slide rails 198 beneath the opening in plate 112 to prevent debris from being drawn into the suction inlet 191 of the vacuum pump. A flexible seal or gasket 197 is affixed to the underside of plate 112 around the filter 196.

A removable waste receptacle 200 having an upper lip 201 is supported on a platform 202 in the lower section 106 of the frame and is vertically movable by an air cylinder 204 between a first position resting on platform 202 as shown in FIG. 3 to a second, raised position in which the upper lip 201 of the receptacle engages and seals against gasket 197. In this raised position, a vacuum is created in waste receptacle 200 by the vacuum pump 190. A Y-connector 206 mounted to plate 112 communicates via an opening (not shown) in plate 112 with the interior of waste receptacle 200. A pair of flexible hoses 208, 210 are connected to the Y-connector 206. Hoses 208, 210 are connected to a respective suction fitting 212,214 mounted directly above cutter knife 138 and below cutter knife 140 adjacent the location at which the top and bottom end panels of the cigarette packs P are cut off by the knives. The above-described vacuum system thus provides a means for sucking away and collecting the cut off end panels of the packs P as well as any dust or debris resulting from the cutting operation.

The electrical control circuits for the pack opener apparatus 100 are located in an enclosure 107 in the lower section 106. Controls for the operation of the drive motor 152, vacuum pump 190, indexing drive motor 130 and air cylinder 204 are conventional and therefore need not be described in further detail. The proximity sensor 135 is connected in the electrical circuit for the indexing drive motor 130 in such a way as to initiate one indexing movement of the conveyor 118 when a pack P drops into the infeed station 136. Preferably, one indexing movement of the conveyor 118 (about 3 inches) moves the pack P through the cutting knives 138, 140.

The pack opener apparatus 100 operates in the following manner. The vacuum pump 190, the drive motor 152 for the knives 138, 140 and the indexing drive motor 130 are turned on. Air cylinder 204 is operated to raise the receptacle 200 into sealing engagement with gasket 197 thereby initiating suction at the fittings 212, 214 for carrying off the end panels, dust and debris from the cutting operation.

When a cigarette pack P drops from the chute 116 into the infeed position 136, proximity sensor 135 senses the presence of the pack and signals wrap spring clutch 132 to index the conveyor 118. This indexing movement carries the pack P through the cutting station where cutter knives 138, 140 cut off the top and bottom panels which are then sucked into the waste receptacle 200 via fittings 212, 214, hoses 208, 210 and Y-connector 206. When the pack P passes the cutting station at the end of the indexing movement, the infeed station 136 is clear and another pack P drops into the station 136. The proximity sensor 135 senses the presence of pack P and transmits another indexing signal and so on.

Figure 7:
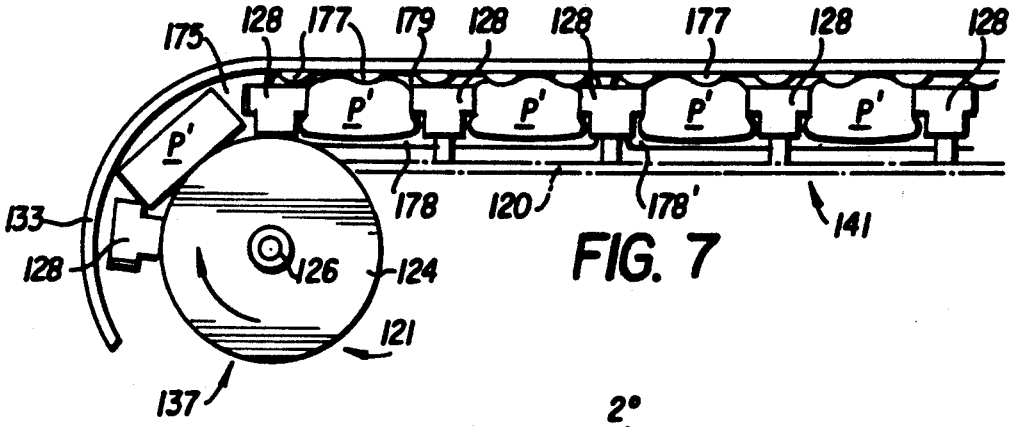
FIG. 7 is a fragmentary top view of a portion of the pack opener showing the deformation of the cigarette packs after the end panels have been cut off.

Referring now to FIGS. 4 and 7, as the now opened packs P' travel from the arcuate portion 137 of the conveyor 118 to the linear portion 141, the distance between the pusher bars 128 decreases so that adjacent pusher bars engage the sides of each pack P' and deform the same. Such deformation of the packs P' results in an increase of the transverse cross-sectional area of the packs P thereby loosening the cigarette matrix in each pack P'. The thus deformed packs P' are indexed over the drop out windows 178, 178' which extend substantially the entire length of the linear portion 141 of the conveyor. Because the cigarette matrix, e.g., the 7-6-7 matrix, has been loosened, the individual cigarettes in the pack fall by gravity from the pack, through the windows 178, 178' and into funnel 182 (FIG. 3) where they pass into cigarette outlet pipe 184.

It has been found advantageous to provide a narrow strip 179 of sheet metal, such as stainless steel, along the outermost edge of drop out window 178 to engage and support a lower cut edge of the deformed cigarette packs P' as the packs are advanced from slide plate 175 to a position over the window 178. The top surface of strip 179 is preferably substantially coplanar with the top surface of slide plate 175 so that the cut edges of the deformed packs P' are guided directly onto the strip 179 from slide plate 175.

The retaining wall 133 may be provided with a plurality of smooth projections 177 which serve to agitate, bump or jog the packs P' as they travel along the linear portion 141 so as to free up any cigarettes that are compacted or otherwise do not separate freely from the packs when they are initially deformed.

When the packs P' reach the end of linear portion 141, the cigarettes in each pack have dropped from the packs leaving only the front, back and side panels, of the package. As the packs travel about the periphery of shaft assembly 122, the distance between the pusher bars 128 again increases thereby allowing the now empty packs to drop by gravity through discharge opening 180 and fall onto chute 186 from which they are collected in a waste receptacle or conveyor (not shown) located in the rear of the apparatus (FIG. 4).

The pack opener apparatus 100 may be used as a stand-alone apparatus or in combination with the maker/tipper/packer shown in FIG. 1. In that combination, the conveyor 72 which carries reject packs is connected to the chute 116 of pack opener 100 and the outlet pipe 184 is connected to the conveyor 74 which carries individual cigarettes to the tobacco reclamation unit 30.

The pack opener apparatus 100 of the present invention could also be operated with a single cutter knife in the position of the lower knife 140 so that only one end panel is removed from the packs. In such an arrangement, the pack matrix may be more difficult to loosen by the above-described deformation of the pack and additional means for agitating or vibrating the opened packs may be required. It would also be possible to orient the conveyor 118 so that the rotational axes of the shafts 126, 127 are arranged horizontally rather than vertically. Removal of the cigarettes from the open packs would be accomplished by other means, such as the air jets described in our aforesaid copending application Ser. No. 493,082.

FIGS. 8–10 illustrate a presently preferred embodiment of the pusher bars 128. The pusher bars are formed from a generally rectangular block 220 of material, such as metal or plastic. The upstream or trailing side 221 of each pusher bar 128 is tapered at an angle A of about 2° from bottom to top. The taper helps to prevent the empty packs P' (FIG. 7) from falling downwardly into the openings 178, 178', in effect, acting to "wedge" the empty packs between the pusher bars. The downstream or leading side 223 of each pusher bar 128 could also be tapered for the same purpose. It is preferred, however, that the leading sides of the pusher bars are not tapered, but are normal to the path of travel of the packs so that when the leading sides of the pusher bars 128 contact the sides of the packs P, the packs are not tilted at an angle when they pass through the cutter knives 138, 140. See FIG. 6. This tapered design of the pusher bars for wedging the empty packs P' between the pusher bars to prevent them from falling into the openings 178, 178' is in addition to the above-described strip 179 mounted adjacent the opening 178 for supporting the lower cut edges of the empty packs P'.

Figure 6A:
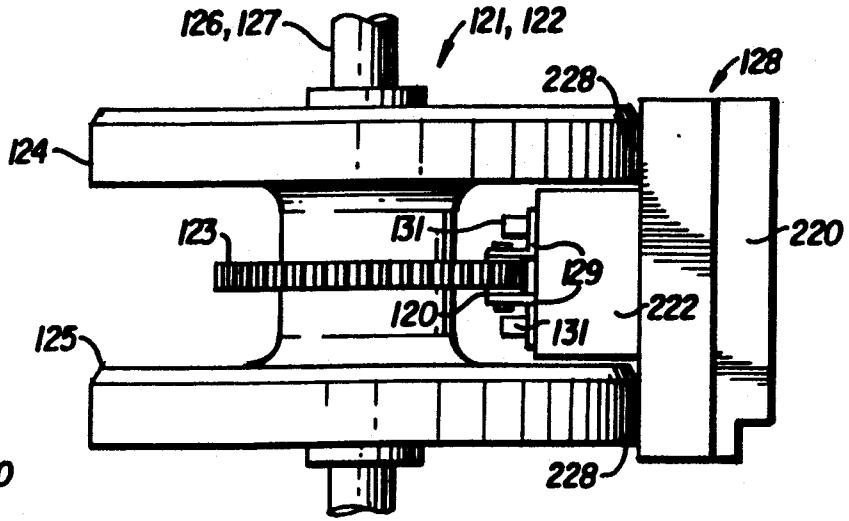
FIG. 6A is a partial side elevation view of a detail of the pack opener apparatus of the invention.

The pusher bars 128 are fastened to the chain 120 by means of a projection 222 extending from the back of each pusher bar. The projection 222 is provided with a pair of threaded bores 224, 226 into which bolts 131 (FIG. 6A) are threaded. As best seen in FIG. 6A, the projection 222 has a depth or length sufficient to permit the rear face 228 of each pusher bar to contact and be supported by the upper and lower pressure rollers 124, 125. A pair of longitudinal recesses 230, 232 are formed on the sides of the bars adjacent the rear face 228 to accommodate the corners of the cigarette packs as they traverse the arcuate portion 137 of the conveyor.

It will be appreciated that the pusher/squeeze bars 128 function to engage the cigarette packs P as they enter the pack opener at the infeed station 136 and convey the packs about the arcuate portion 137 past the cutter knives 138, 140 in a substantially vertical orientation. When the pusher/squeeze bars travel to the linear portion 141, the distance between adjacent bars decreases so as to compress or squeeze the packs P' between them and loosen the cigarette matrix in the packs P'.

Figure 11:
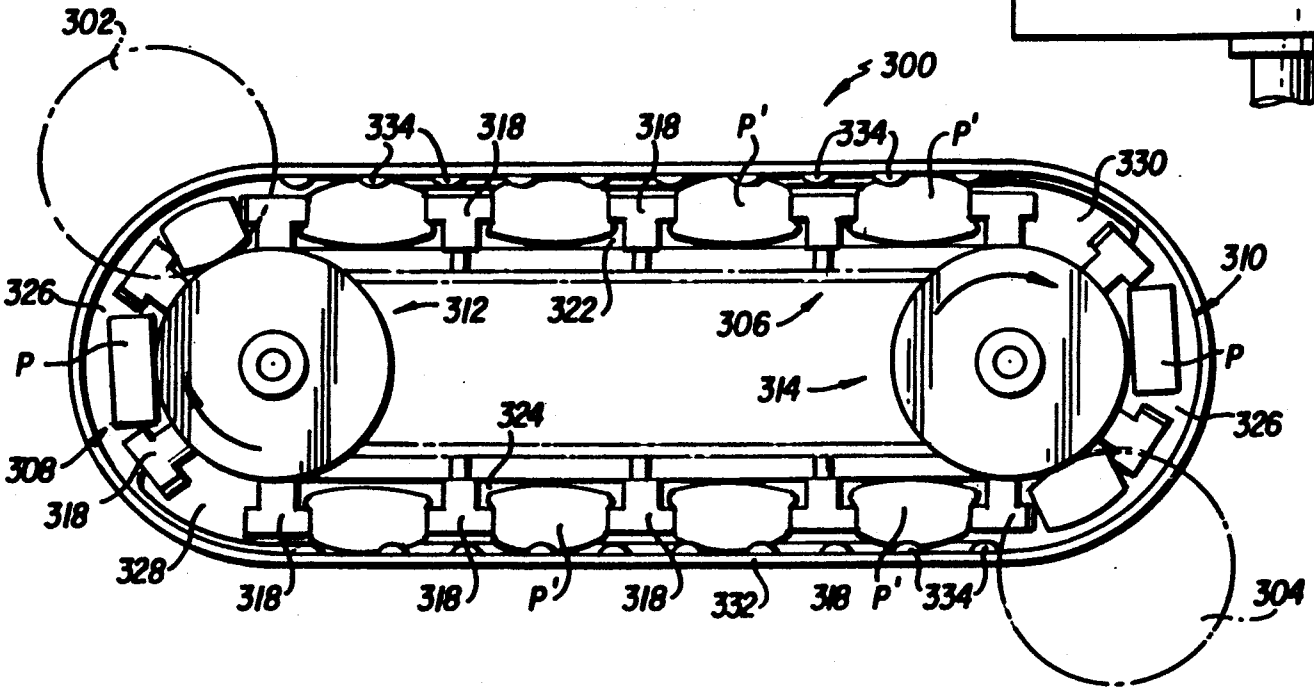
FIG. 11 is a top elevation view of an alternate embodiment of the present invention.

An alternate embodiment of the pack opener invention is illustrated in FIG. 11 wherein a pack opener 300 is provided with two pair of cutter knives 302, 304 arranged at opposite ends of an endless pack conveyor 306. Infeed stations 308, 310 are located at each end of the conveyor 306 for receiving a supply of cigarette packs P via two infeed chutes (not shown) similar to infeed chute 116 shown in FIG. 3. Shaft assemblies 312, 314 are constructed in the same manner as shaft assemblies 121, 122 shown in FIG. 6A and may be driven by the same mechanism used to drive the conveyor 118 of pack opener 100.

Conveyor 306 comprises a link chain 316 trained about the sprockets (not shown) of shaft assemblies 312, 314 and a plurality of pusher/squeeze bars 318 mounted in spaced relation along chain 316. The pusher bars 318 are spaced along chain 316 in the same manner as described above to provide space to accommodate the infeed of cigarette packs P between the bars along the arcuate portions of the conveyor 306 and to transport the packs P through the cutter knife pairs 302, 304. From the arcuate conveyor portions, the bars 318 carry the packs to the linear portions of the conveyor where the bars compress or squeeze and thereby deform the packs into a different transverse cross section as shown by packs P' FIG. 11. Such deformation loosens the cigarette matrix and allows the cigarettes in each pack P' to drop by gravity through elongated openings 322, 324 in support plate 326 on opposite sides of the conveyor 306. The downstream ends of the openings 322, 324 are curved about the shaft assemblies to form drop out windows 328, 330 for the empty pack wrappers. The conveyor is surrounded by an upstanding wall 332 for retaining the packs P, P' on the conveyor 306. Projections 334 are mounted on the inside surface of the wall 332 along the linear portions thereof for agitating the packs P' to thereby aid in emptying all the cigarettes from the packs.

It will be appreciated that the operation and construction of the alternate embodiment is substantially similar to that of the embodiment illustrated in FIGS. 3–10, except that the reclamation capacity of the alternate embodiment is essentially twice that of the embodiment of FIGS. 3–10. Accordingly, construction details of other non-illustrated portions of the pack opener 300 will be apparent to one skilled in the art by referring to the pack opener 100 shown in FIGS. 3–10 and the description thereof.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. Apparatus for removing cigarettes from a cigarette pack having parallel front and rear panels, a pair of parallel side panels, and a pair of parallel end panels, the longitudinal axes of the cigarettes in the pack being disposed transverse to the end panels, said pack having a thickness dimension between the front and rear panels, a width dimension greater than the thickness dimension between the side panels and a cross-sectional area transverse to the longitudinal axes of the cigarettes in the pack, said apparatus comprising:

means for conveying the cigarette pack along a path of travel having at least one arcuate portion and at least one linear portion;

means for driving said conveying means along said path;

means for opening at least one end panel of the pack; and a plurality of pusher means mounted on said conveying means and movable along the arcuate and linear portions of said path for advancing the cigarette pack along said path and for engaging the side panels of the pack and deforming the pack along the width dimension thereof to increase the transverse cross-sectional area of the pack as the pack is advanced along the linear portion of said path of travel whereby the cigarettes in the pack are removable from the opened end panel of the pack.

2. The apparatus of claim 1, including means for supplying the cigarette pack to the conveying means between said adjacent pusher means in a direction transverse to the path of travel of the conveying means at a point on the arcuate portion of said path.

3. The apparatus of claim 2, wherein said driving means comprises an indexing drive means for intermittently moving said pusher means along said path of travel and including means located adjacent said point for sensing the presence of the cigarette pack at said point, said sensing means being connected to means for controlling said drive means.

4. The apparatus of claim 1, wherein said conveying means comprises an endless conveyor having two arcuate portions and two linear portions, and including means for supplying the cigarette pack to the conveying means between said adjacent pusher means at a point on at least one of the arcuate portions of the path of travel.

5. The apparatus of claim 4, wherein said supplying means includes first and second means for supplying cigarette packs between adjacent pusher means at a point on each arcuate portion of the path of travel.

6. The apparatus of claim 4, wherein said endless conveyor comprises two shaft assemblies, each shaft assembly comprising a sprocket disposed between a pair of pressure rollers, an endless chain trained about said sprockets, said driving means being drivingly connected to one of said shaft assemblies.

7. The apparatus of claim 6, wherein said pusher means are connected to said endless chain.

8. The apparatus of claim 1, wherein said opening means comprise at last one cutting knife for cutting open said one end of the pack.

9. The apparatus of claim 1, wherein said opening means comprises a pair of circular cutting knives arranged on the arcuate portion of the path of travel for cutting off the end panels of the pack as the pack is conveyed along the arcuate portion of the path past the cutting knives.

10. The apparatus of claim 9, wherein a first one of said circular cutting knives is arranged in a plane substantially parallel to a plane parallel to and containing the path of travel of the pack being conveyed, the second one of said circular knives being arranged in a plane inclined at a selected angle to the plane containing the path of travel of the pack being conveyed.

11. The apparatus of claim 10, wherein said selected angle is about 2°.

12. The apparatus of claim 11, wherein the axis of rotation of said first cutting knife is a substantially vertical axis.

13. The apparatus of claim 1, wherein said pusher means comprise a plurality of pusher/squeeze bars each having leading and trailing sides, said leading side being arranged substantially perpendicular to the path of travel, said trailing side being inclined at a predetermined angle from the path of travel.

14. The apparatus of claim 13, wherein said predetermined angle is about 2°.

15. The apparatus of claim 13, wherein only said leading side of each of said bars contacts a cigarette pack on the arcuate portion of the conveying means and said leading and trailing sides of said bars contact cigarette packs on the linear portion of said conveying means whereby said cigarette packs are squeezed by said bars on the linear portion of said conveying means.

16. The apparatus of claim 1, wherein the cigarettes in the pack are removed therefrom by gravity by falling from an open end of the pack and means disposed beneath the linear portion of the conveying means for collecting said cigarettes.

17. The apparatus of claim 16, including means disposed beneath the arcuate portion of the conveyor for collecting the empty pack after the cigarettes have fallen therefrom.

18. The apparatus according to claim 1, including means disposed adjacent the conveying means for agitating the pack to assist in the removal of the cigarettes from the open end of the pack.

19. The apparatus according to claim 18, wherein said agitating means comprise a plurality of projections disposed adjacent the linear portion of the conveying means for contacting said cigarette pack as it is conveyed along said linear portion.

20. The apparatus according to claim 18, including a wall arranged in spaced relation to the conveying means, said agitating means being mounted on said wall.

21. A method of removing cigarettes from a cigarette pack having parallel front and rear panels, a pair of parallel side panels, and a pair of parallel end panels, the longitudinal axes of the cigarettes in the pack being disposed transverse to the end panels, said pack having a thickness dimension between the front and rear panels, a width dimension greater than the thickness dimension between the side panels and a cross-sectional area transverse to the longitudinal axes of the cigarettes in the pack, said method comprising the steps of:

conveying the cigarette pack with a plurality of pushers along a path of travel having at least one arcuate portion and at least one linear portion;

opening at least one end of the pack;

deforming the pack with the pushers as the pack is conveyed along the linear portion of the path of travel to increase the transverse cross-sectional area of the pack; and emptying the cigarettes in the pack from the opened end of the pack.

22. The method of claim 21, including the step of discarding the emptied pack as it is conveyed along an arcuate portion of the path of travel.

23. The method of claim 22, wherein the cigarettes are emptied from the pack by gravity and the emptied pack is discarded by gravity.

24. The method of claim 21, wherein said opening step comprises the step of cutting off both end panels of the pack when the pack is conveyed along an arcuate portion of the path of travel.

25. The method of claim 21, including the step of conveying the emptied pack from a linear portion of the path of travel to an arcuate portion of the path of travel and discarding the emptied pack on the arcuate portion.

26. The method of claim 21, including the step of inserting the cigarette pack into the path of travel on arcuate portion thereof.

27. The method of claim 26, wherein said inserting step includes the step of inserting the pack between an adjacent pair of pushers in a direction transverse to the path of travel.

28. The method of claim 21, wherein said path of travel is an endless path having two arcuate portions and two linear portions and including the steps of inserting a cigarette pack into the path of travel at each arcuate portion thereof, cutting off at least one end panel of each pack as the packs are conveyed along said arcuate portions and emptying the cigarettes from the open ends of the packs as the packs are conveyed along said linear portions.

29. The method of claim 28, including the steps of collecting the cigarettes emptied from the packs and separately collecting the emptied packs.

30. The method of claim 21, including the step of agitating the pack to assist in emptying the cigarettes from the pack.

31. The method of claim 21, wherein said deforming step includes the step of squeezing the pack between an adjacent pair of pushers.

* * * * *